US006082463A

United States Patent [19]

Ponte

[11] Patent Number: 6,082,463

[45] Date of Patent: Jul. 4, 2000

[54] CONCEALED EXTENDED COVERAGE QUICK RESPONSE SPRINKLER

[75] Inventor: Gary W. Ponte, Livingston, N.J.

[73] Assignee: The Reliable Automatic Sprinkler Co. Inc., Mt. Vernon, N.Y.

[21] Appl. No.: 09/216,178

[22] Filed: Dec. 18, 1998

[51] Int. Cl.[7] ..... A62C 37/08

[52] U.S. Cl. ..... 169/41; 239/788.5; 239/518

[58] Field of Search ..... 239/504, 523, 239/524, 288.5; 169/37, 38, 40, 41

[56] References Cited

U.S. PATENT DOCUMENTS

| | | | |
|---|---|---|---|
| 1,285,133 | 11/1918 | Gross . | |
| 2,025,063 | 12/1935 | Loepsinger . | |
| 2,135,138 | 11/1938 | Kendall . | |
| 4,014,388 | 3/1977 | Anderson . | |
| 4,066,129 | 1/1978 | Anderson . | |
| 4,296,815 | 10/1981 | Mears | 239/504 |
| 4,585,069 | 4/1986 | Whitaker . | |
| 4,662,455 | 5/1987 | Simons | 169/37 |
| 4,880,063 | 11/1989 | Leininger et al. . | |
| 4,926,946 | 5/1990 | Polan . | |
| 4,976,320 | 12/1990 | Polan . | |
| 4,977,963 | 12/1990 | Simons . | |
| 5,036,923 | 8/1991 | Shea, Sr. . | |
| 5,083,616 | 1/1992 | Polan . | |
| 5,152,344 | 10/1992 | Fischer et al. . | |
| 5,372,203 | 12/1994 | Galaszewski | 169/37 |
| 5,664,630 | 9/1997 | Meyer et al. . | |
| 5,669,449 | 9/1997 | Polan et al. | 169/37 X |

*Primary Examiner*—Kevin Weldon
*Attorney, Agent, or Firm*—BakerBotts, LLP

[57] ABSTRACT

A concealed extended coverage quick response sprinkler has a sprinkler body with an axial passage for water, a cap normally closing the axial passage, and a thermally responsive structure supported from a pair of frame arms retaining the cap in position. A deflector slidably supported from the sprinkler body includes a substantially planar imperforate plate with opposed peripheral edge portions disposed on opposite sides of a plane containing the frame arms which are bent away from the sprinkler body. The sprinkler has a K factor of about 11.4 and provides quick response for light hazards at spacings up to 18 feet and standard response for light hazards at spacings of 20 feet.

18 Claims, 2 Drawing Sheets

CONCEALED EXTENDED COVERAGE QUICK RESPONSE SPRINKLER

BACKGROUND OF THE INVENTION

This invention relates to fire prevention sprinklers for distributing a fire extinguishing liquid such as water in an environment which is subject to a fire hazard.

Many conventional fire prevention sprinklers consist of a threaded sprinkler body connected to a water supply pipe to receive water under pressure and having a heat-responsive arrangement blocking a passage in the sprinkler body which is set to open the passage when the temperature in the vicinity of the sprinkler exceeds a selected value. In order to distribute the water emerging from the sprinkler passage throughout the area to be protected, the sprinkler includes a deflector which is supported from the sprinkler body by arms so that water emerging from the sprinkler passage upon activation of the sprinkler impinges the deflector and is distributed thereby over the area to be protected.

Concealed sprinklers are usually covered by a cover plate which is substantially flush with a ceiling in which the sprinkler is mounted and have a deflector supported from the sprinkler body by sliding pins rather than fixed arms, permitting the deflector to be held in a retracted position above the ceiling and adjacent to the sprinkler body and to drop down to an extended position below the surface of the ceiling automatically and concurrently with the operation of the sprinkler after the cover has been released by a high temperature condition. For light hazard occupancies a quick response sprinkler having an 11 K factor should be able to distribute water substantially uniformly over areas of 16'×16' or 18'×18' for quick response and 20'×20' for standard response, but uniform distribution patterns for concealed extended coverage sprinkler have been difficult to achieve over such areas with conventional deflector arrangements.

The Leininger et al. U.S. Pat. No. 4,880,063 discloses an adjustable concealed sprinkler having a circular drop-down deflector supported by sliding pins and provided with an array of peripheral slots. The Meyer et al. U.S. Pat. No. 5,664,630 discloses a concealed extended coverage sprinkler arrangement having a drop-down deflector consisting of a planar deflector plate having radial slots and a central protrusion extending axially toward the sprinkler passage and supported by sliding pins from the sprinkler body. The Galaszewski U.S. Pat. No. 5,372,203 also discloses a drop-down concealed sprinkler having a deflector with radial slots supported by sliding pins from the sprinkler body. The Fischer et al. U.S. Pat. No. 5,152,344 and the Polan U.S. Pat. No. 5,083,616 disclose similar arrangements.

SUMMARY OF THE INVENTION

Accordingly, it is an object of the present invention to provide an extended coverage concealed sprinkler which overcomes disadvantages of the prior art.

Another object of the invention is to provide an extended coverage concealed sprinkler providing quick response coverage for light hazard occupancies at spacings up to eighteen feet and standard response coverage at spacings up to twenty feet.

These and other objects of the invention are attained by providing a sprinkler having a sprinkler body with an axial passage for water normally covered by a cap retained in position by a thermally responsive element and a deflector slidably supported by arms extending from the sprinkler body for motion between a retracted position adjacent to the sprinkler body and an extended position, in which the deflector has a substantially planar imperforate structure with opposed portions of the periphery of the deflector on opposite sides of a plane containing the arms being bent in the direction away from the sprinkler body passage. In a preferred embodiment, the deflector is supported on pins which pass through the arms extending from the sprinkler body and has a central stream-splitting projection extending toward the sprinkler body passage. In addition, the bent portions at the periphery of the deflector on opposite sides of the arms extend away from the planar portion of the deflector at approximately the same angle that the arcuate surface of the projection intercepts the plane of the deflector.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
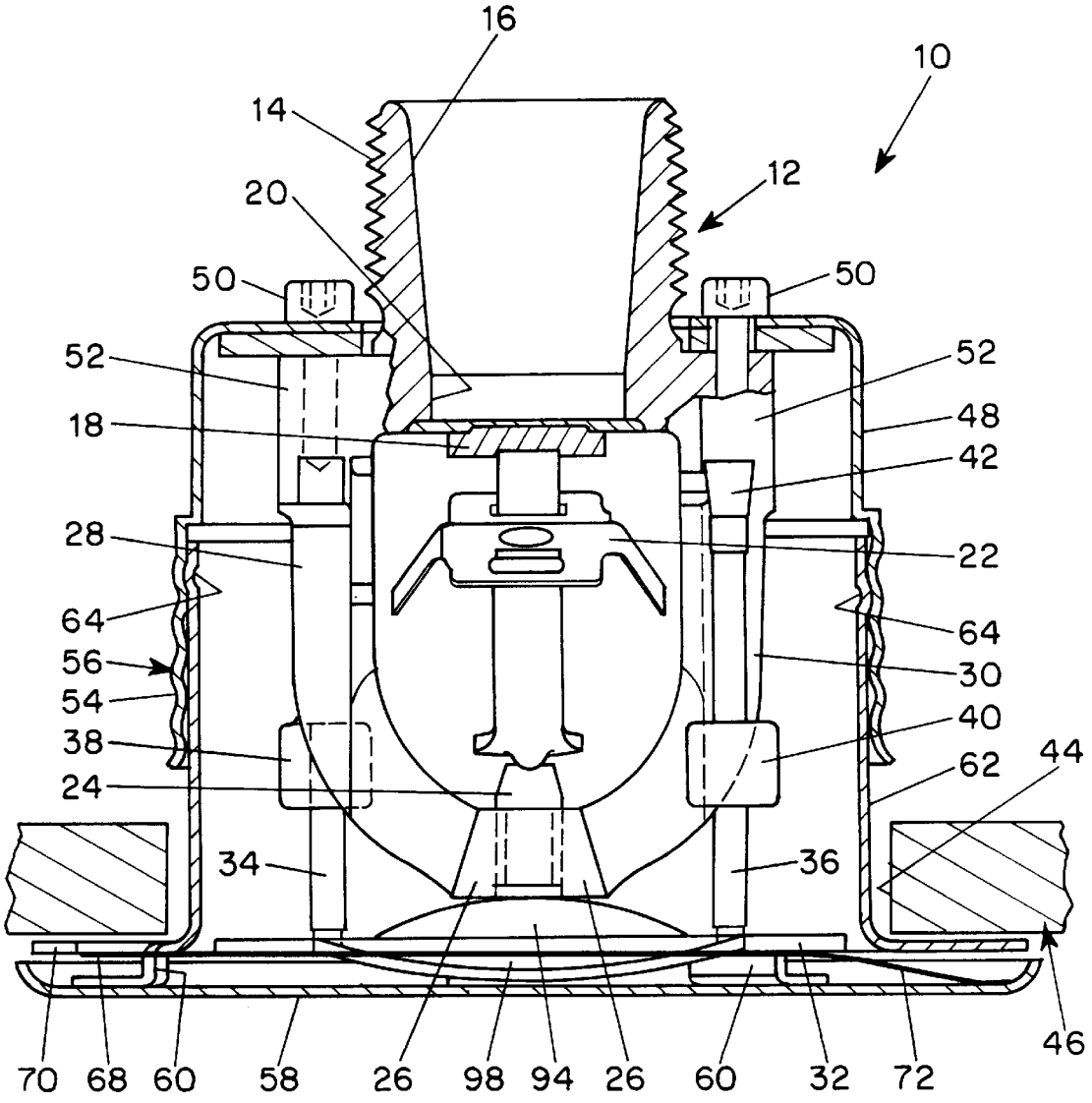
FIG. 1 is a view in longitudinal section illustrating a representative embodiment of a quick response extended coverage concealed sprinkler in accordance with the invention.

In the typical embodiment of the invention shown in FIG. 1, a concealed sprinkler 10 has a sprinkler body 12 with a threaded end 14 adapted to be connected to a water supply line and an internal passage 16 through which water from the supply line passes when the sprinkler has been activated. A cap 18 is normally retained in place over an orifice 20 at the end of the passage 16 by a thermally responsive structure 22 which may, for example, consist of a lever assembly retained in position by solder material which fuses at a selected temperature such as 165° C. Alternatively, a thermally responsive glass bulb may be used.

The lever assembly 22 engages the cap 18 at one end and is supported at the opposite end by a screw 24 which extends through a boss 26 formed at the junction of two arms 28 and 30 extending parallel to the sprinkler axis from the sprinkler body 12. A deflector 32, described in more detail hereinafter, is supported by two pins, 34 and 36, which are slidably received in corresponding guides 38 and 40 in the arms 28 and 30, respectively. The pins 34 and 36 have enlarged heads 42 providing a close-fitting engagement with correspondingly shaped shoulders in the guides 38 and 40 thereby limiting downward motion of the deflector in the extended position while retaining the deflector 30 in an orientation substantially perpendicular to the sprinkler axis.

The concealed sprinkler 10 is arranged to be positioned in an opening 44 in a ceiling panel 46 and, in the illustrated embodiment, a cup-shaped cover support 48 is mounted on the sprinkler body 12 by screws 50 which are received in threaded openings in lateral projections 52 of the sprinkler body. The cup-shaped cover support 48 is formed with a thread 54 in a cylindrical extension 56.

A substantially planar cover member 58 is joined by solder joints to depending tabs 60 of a sleeve 62 which is received within the extension 56 and which has a plurality of helically arranged projections 64 positioned and shaped to engage the thread 54 of the extension 56 of the cover support 48, thereby permitting the cover 58 to be axially adjustably mounted with respect to the sprinkler body 12 by rotation of the sleeve 62 within the cover support 48. A leaf spring 68 engages a circumferential shoulder 70 on the sleeve 62 and has a plurality of spring fingers 72 urging the rim of the cover 58 in the direction away from the sleeve member 62 as described for example in the Leininger et al. U.S. Pat. No. 4,880,063. The solder joints holding the cover 58 to the tabs 60 are arranged to melt at a temperature about 10°–30° C. below the release temperature of the thermally responsive structure 22, for example at 135° F., so as to assure early release of the cover and prompt exposure of the thermally responsive element 22 to an elevated temperature condition in the vicinity of the sprinkler.

Accordingly, when the ambient temperature in the vicinity of the sprinkler exceeds the melting temperature of the solder joints holding the cover 58 to the tabs 60, the depending fingers 72 of the leaf spring 70 force the cover 58 away from the sprinkler body and, when the elevated temperature exceeds the release temperature of the thermally responsive structure 22, the lever assembly comprising that structure is released, permitting the cap 18 to be forced away from the orifice 20 by the pressure of water in the passage 16. At the same time, the deflector 32, which is no longer supported by the cover 58 and is subjected to water under pressure emerging from the orifice 20, drops below the level of the ceiling 46 until the enlarged portions 42 of the pins 34 and 36 are held in the guides 38 and 40 so that the deflector is retained in the extended position beneath the ceiling panel 46, enabling distribution of water from the orifice 20 over the area to be protected.

Figure 2:
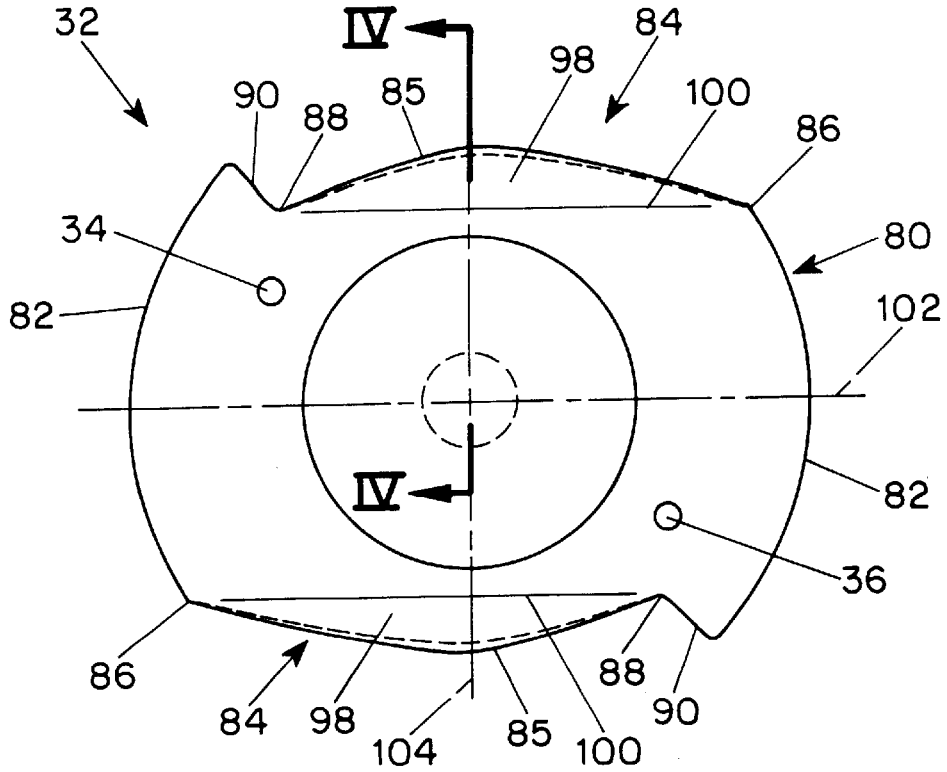
FIG. 2 is a plan view of the deflector used in the sprinkler of FIG. 1.
Figure 3:
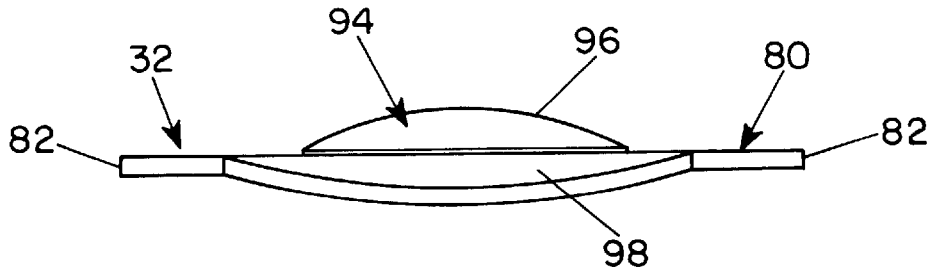
FIG. 3 is a side view of the deflector of FIG. 2.
Figure 4:
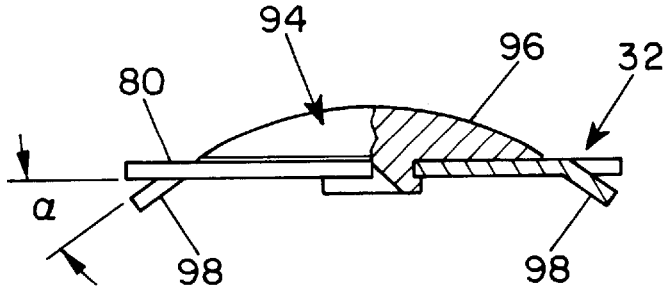
FIG. 4 is a side view of the deflector looking in an orthogonal direction with respect to the view of FIG. 3, partly in section taken along the line IV—IV of FIG. 3.

In order to provide the desired extended coverage of the sprinkler, the sprinkler deflector 32, as shown in FIGS. 2–4, consists of an imperforate metal plate 80 having two opposed arcuate peripheral portions 82, each extending over approximately 40° to 80°, preferably about 60°, of the periphery of the disk, and two further opposed peripheral portions 84, each extending over approximately 100° to 140°, preferably about 120°, of the periphery of the plate and having a peripheral edge 85 which curves inwardly from one end at an intersection 86 with one arcuate peripheral portion 82 to the other end at an intersection 88 with an edge portion 90 extending radially inwardly from the other arcuate peripheral portion 82. In a preferred embodiment, the diameter of the plate 80 which extends through the arcuate portions 82 is between about 1.9 inches and 2.2 inches preferably between 2.0 inches and about 2.1 inches and desirably about 2.05 inches. The ends of the slidable support pins 34 and 36 are affixed to the plate 80 at locations spaced radially inwardly from the arcuate peripheral portions 82 and are spaced angularly from the intersection points 88 by about 10° to 20° and the length of the pins is selected to position the deflector about 2 to 3 inches, preferably about 2.3 inches to 2.7 inches and desirably about 2.5 inches, from the orifice 20 in the exended condition.

As best seen in FIGS. 3 and 4, a water stream splitter member 94 having a spherical upper surface 96 is affixed in a central opening in the disk 80, the surface 96 having a radius which is approximately half of the radius of the arcuate peripheral portions 82. In addition, the outer regions 98 of the peripheral portions 84 are bent downwardly, away from the sprinkler body 12, at an angle of about 30° to 45°, preferably about 38°, from the plane of the deflector 80 along bend lines 100 which are parallel to a central line 102 of the deflector which extends along the plane of the sprinkler frame arms 28 and 30. The bend lines 100 intersect the points 86 and 88 and are perpendicular to and intersect an orthogonal center line 104 at a spacing from the center of the deflector approximately one third the radius of the arcuate portions 82 so that the angle at which the spherical surface 96 intersects the surface of the deflector plate 80 is substantially the same as the angle formed with the deflecting plate 80 by the downwardly bent regions 98, as indicated in FIG. 4, permitting water to flow directly from the surface 96 to the surface of the bent regions 98.

In operation, when the thermally responsive element is activated at an elevated temperature, the lever assembly 22 supporting the cap 18 collapses, releasing the cap and permitting water passing through the orifice 20 to impinge on the deflector 32, causing the deflector to be moved away from the sprinkler body 12 until the enlarged portions 42 of the pins 34 and 36 engage corresponding shoulders in the portions 38 and 40. The impinging water is then distributed circumferentially around the splitter 94 so as to be spread substantially uniformly in all directions about the axis of the sprinkler, with the portions which flow away from the plane of the sprinkler frame arms 28 and 30 being directed partially downwardly by the downwardly bent regions 98 of the deflector and the water distributed in the region of the plane of the frame arms 28 and 30 corresponding to the deflector diameter 102 being directed outwardly by the portions of the deflector which extend outwardly in the plane of the deflector to the peripheral regions 82 so as to assure substantially uniform distribution of the water over an area of 18'×18' for example, for quick response light hazard conditions, and 20'×20' for standard response light hazard conditions.

Although the invention has been described herein with reference to specific embodiments, many modifications and variations therein will readily occur to those skilled in the art. Accordingly all such variations and modifications are included within the intended scope of the invention.

I claim:

1. A concealed sprinkler arrangement comprising a sprinkler body having an axial passage for delivery of fire extinguishing fluid and a deflector extending in a plane substantially perpendicular to the axis of the sprinkler body and slidably supported by support members projecting from the sprinkler body for motion between a retracted position adjacent to the sprinkler body and an extended position spaced from the sprinkler body, the deflector comprising a substantially planar imperforate plate member having an outer periphery with two opposed peripheral edge regions bent away from the plane of the plate member in a direction away from the sprinkler body on opposite sides of a plane containing the support members.

2. A concealed sprinkler arrangement according to claim 1 wherein the support members comprise support arms which meet at a boss on the sprinkler axis and including a cap closing the axial passage and a thermally responsive structure extending between the cap and the boss and normally holding the cap in its position closing the axial passage.

3. A concealed sprinkler arrangement according to claim 1 having a K factor of about 11 and providing quick response for light hazards at spacings up to 18 feet and standard response for light hazards at spacings of 20 feet.

4. A concealed sprinkler arrangement according to claim 1 wherein the deflector plate member has two opposed arcuate peripheral portions extending in substantially the same plane as the plate member which are intersected by the plane containing the support members.

5. A sprinkler arrangement according to claim 1 wherein each of the opposed peripheral edge regions is curved inwardly from an intersection with an arcuate peripheral portion to a substantially radial peripheral edge portion intersecting an opposed arcuate peripheral portion.

6. A sprinkler arrangement according to claim 1 wherein the deflector includes a stream splitter having a spherical surface on the imperforate plate member facing the axial passage in the sprinkler body.

7. A sprinkler arrangement according to claim 6 wherein the peripheral edge regions are bent away from the plane of the plate member at an angle which is approximately the same as the angle of intersection of the spherical surface of the stream splitter with the surface of the plate member.

8. A sprinkler arrangement according to claim 7 wherein the peripheral edge regions are bent away from the plane of the plate member at an angle in the range from about 30° to about 45°.

9. A sprinkler arrangement according to claim 1 wherein each of the two opposed peripheral edge regions extend over an angle of about 100° to about 140° of the periphery of the plate member.

10. A sprinkler arrangement according to claim 9 wherein each of the two opposed peripheral edge regions exend over an angle of about 120°.

11. A sprinkler arrangement according to claim 4 wherein each of the two opposed arcuate peripheral portions extend over an angle of about 40° to about 80°.

12. A sprinkler arrangement according to claim 11 wherein each of the two opposed arcuate peripheral portions extends over an angle of about 60°.

13. A sprinkler arrangement according to claim 1 wherein the outer periphery of the plate member has a maximum diameter in the range from about 1.90 inches to about 2.2 inches.

14. A sprinkler arrangement according to claim 13 wherein the outer periphery of the plate member has a maximum diameter in the range from about 2.0 inches to about 2.1 inches.

15. A sprinkler arrangement according to claim 14 wherein the outer periphery of the plate member has a maximum diameter of about 2.05 inches.

16. A sprinkler arrangement according to claim 1 wherein the deflector plate member is spaced from the axial passage by a spacing of about 2 inches to 3 inches in the extended position.

17. A sprinkler arrangement according to claim 16 wherein the deflector plate member is spaced from the axial passage by a spacing of about 2.3 inches to 2.7 inches in the extended position.

18. A sprinkler arrangement according to claim 17 wherein the deflector plate member is spaced from the axial passage by a spacing of about 2.5 inches in the extended position.

* * * * *